US008409777B2

(12) United States Patent
Tsubaki et al.

(10) Patent No.: US 8,409,777 B2
(45) Date of Patent: Apr. 2, 2013

(54) TONER AND METHOD OF MANUFACTURING THE SAME

(75) Inventors: Yoritaka Tsubaki, Nara (JP); Yasuhiro Shibai, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 859 days.

(21) Appl. No.: 11/822,937

(22) Filed: Jul. 11, 2007

(65) Prior Publication Data

US 2008/0014521 A1 Jan. 17, 2008

(30) Foreign Application Priority Data

Jul. 11, 2006 (JP) ..... 2006-190926

(51) Int. Cl.
*G03G 9/087* (2006.01)

(52) U.S. Cl. ..... 430/110.3; 430/105; 430/137.14

(58) Field of Classification Search ..... 430/105, 430/110.3, 137.14
See application file for complete search history.

(56) References Cited

U.S. PATENT DOCUMENTS 5,308,734 A * 5/1994 Sacripante et al. ..... 430/137.14
5,714,292 A * 2/1998 Anno et al. ..... 430/108.1
2004/0101775 A1* 5/2004 Mikuriya et al. ..... 430/108.4
2004/0136763 A1* 7/2004 Murakami et al. ..... 399/350
2004/0185367 A1* 9/2004 Serizawa et al. ..... 430/124
2004/0197117 A1* 10/2004 Masuda et al. ..... 399/258
2007/0196756 A1* 8/2007 Shibai et al. ..... 430/108.1

FOREIGN PATENT DOCUMENTS

JP 2002-351140 12/2002
JP 2003-84485 A 3/2003
JP 3-577390 7/2004
JP 2005-10246 A 1/2005
JP 2005-24860 1/2005
JP 2005-49394 A 2/2005
JP 3-724309 9/2005

* cited by examiner

*Primary Examiner* — Peter Vajda
(74) *Attorney, Agent, or Firm* — Nixon & Vanderhye P.C.

(57) ABSTRACT

There is provided a toner which can be manufactured in a simple production method and which is excellent in preservation stability and anti-offset property with uniformly-charging performance. The toner is formed of aggregate of resin-containing particles which are obtained by forming amorphous resin particles into slurry and further finely granulating the amorphous resin particles in form of the slurry followed by aggregation of the amorphous resin particles and which contains a binder resin, a colorant, a release agent, and a release agent-dispersing aid, the resin-containing particles having a volume average particle diameter in a range of from 0.4 μm to 1.0 μm.

8 Claims, 4 Drawing Sheets

TONER AND METHOD OF MANUFACTURING THE SAME

CROSS-REFERENCE TO RELATED APPLICATION

This application claims priority to Japanese Patent Application No. 2006-190926, which was filed on Jul. 11, 2006, the contents of which are incorporated herein by reference in its entirety.

BACKGROUND OF THE INVENTION

1. Field of the Invention

The present invention relates to a toner and a method of manufacturing the toner.

2. Description of the Related Art

An image forming apparatus which forms images in an electrophotographic system includes a photoreceptor, a charging section, an exposing section, a developing section, a transfer section, and a fixing section. The charging section charges a surface of the photoreceptor. The exposing section irradiates the charged surface of the photoreceptor with signal light to thereby form an electrostatic latent image corresponding to image information. The developing section supplies a toner contained in a developer to the electrostatic latent image formed on the surface of the photoreceptor so that a toner image is formed. The transfer section transfers the toner image formed on the surface of the photoreceptor to a recording medium. The fixing section fixes the transferred toner image onto the recording medium. The cleaning section cleans the surface of the photoreceptor from which the toner image has been transferred. In the image forming apparatus as described above, the electrostatic latent image is developed by using as the developer a one-component developer containing a toner or a two-component developer containing toner and carrier so that an image is formed. The toner used in the above case is formed of resin particles which are obtained in a manner that, for example, a colorant and a release agent such as wax are dispersed and granulated in binder resin serving as a matrix.

Through the electrophotographic image forming apparatus, an image having favorable image quality can be formed at high speed and low cost. This promotes the use of the electrophotographic image forming apparatus in a copier, a printer, a facsimile, or the like machine, resulting in a remarkable spread thereof in recent years. Simultaneously, the image forming apparatus has faced up to more demanding requirements. Among such requirements, particular attentions are directed to enhancement in definition and resolution, stabilization of image quality, and an increase in image forming speed, regarding an image being formed by the image forming apparatus. In order to fulfill these demands, a two-way approach is indispensable in view of both the image forming process and the developer.

Regarding the enhancement in definition and resolution of the image, the reduction in diameter of toner particles is one of problems to be solved from the aspect of the developer. This is based on the perspective such that it is important to authentically reproduce the electrostatic latent image. As a method of manufacturing the diameter-reduced toner particles, the emulsion aggregation method is known, for example. In the emulsion aggregation method, coloring resin particles containing a binder resin, a colorant, a release agent, and the like ingredient are generated in water and then aggregated to thereby manufacture toner particles.

As the diameter-reduced toner particles manufactured by the emulsion aggregation method, there is a toner in form of aggregated particles of coloring resin particles made of polyester which has a glass transition temperature of 58° C. to 70° C., a softening temperature of 80° C. to 130° C., a number average molecular weight of 2,000 to 10,000, a ratio of the weight number average molecular weight to the number average molecular weight ranging from 2 to 10, and an acid number of 3.8 to 30 mg KOH/g. In the toner, the coloring resin particles have a volume average particle diameter of 0.1 μm to 1 μm, and the aggregated particles have a volume average particle diameter of 4 μm to 10 μm and a shape factor of 120 to 160 (refer to Japanese Examined Patent Publication JP-B2 3577390, for example).

In accordance with the method of manufacturing a toner disclosed in JP-B2 3577390, the toner is manufactured as follows. First of all, toner raw materials including a binder resin, a colorant, and wax are put and thus dispersed in a water-based medium which is obtained by adding a dispersion stabilizer to water, thereby producing in the water-based medium coloring resin particles having a volume average particle diameter of 0.1 μm to 1 μm. Subsequently, to the water-based medium where the coloring resin particles exist, an aggregating agent is added so as to aggregate the coloring resin particles which are then treated with heat. The water-based medium is thereafter removed, resulting in a toner which is formed of aggregated coloring resin particles.

In the method of manufacturing a toner as mentioned above, however, even when the toner raw materials are put and thus dispersed in the water-based medium, poor compatibility between the binder resin and the wax causes particles of a resin, particles of a colorant, and particles of wax to be formed respectively in the water-based medium, instead of forming the coloring resin particles in which the colorant and the wax are dispersed in the binder resin. The toner formed by aggregating those particles will have the particles of pigments and the particles of wax exposed on a surface of the toner. The particles of wax exposed on the surface cause the preservation stability to be decreased. Further, desorption of the wax particles from the toner causes the anti-offset property to be decreased. Moreover, the exposure of the colorant particles causes the toner to exhibit nonuniform charging performance.

In view of the foregoing, there is proposed a method in which fine resin particles and a charge control agent are further attached to toner particles formed of aggregated coloring resin particles, to thus form an encapsulated toner (refer to Japanese Examined Patent Publication JP-B2 3724309, for example). In the method disclosed in JP-B2 3724309, the coloring resin particles are aggregated and then heated and fused to thereby form toner particles. This aggregate of coloring resin particles will have aggregated particles of respective components, and particles of wax will be exposed on a surface of the toner, just as in the case of toner disclosed in JP-B2 3577390. In the case of JP-B2 3724309, the toner particles formed of aggregate of coloring resin particles as described above are treated with heat, pH adjustment, salt addition, and the like process so that the fine resin particles are attached to the toner particles, thus forming the encapsulated toner. The formation of encapsulated toner through attachment of the fine resin particles to the toner particles will prevent the particles of wax from being exposed, thus resulting in enhancement in the preservation stability and the anti-offset property.

In the method of manufacturing an encapsulated toner disclosed in JP-B2 3724309, however, in order to make fine resin particles be attached to the toner particles, it is necessary to treat the toner particles with heat, pH adjustment, salt addition, and the like process, thus requiring complicated operations. Consequently, there has been a demand for a toner which can be manufactured in a simple production method and which is excellent in the preservation stability and the anti-offset property.

SUMMARY OF THE INVENTION

An object of the invention is to provide a toner which can be manufactured in a simple production method and which is excellent in preservation stability and anti-offset property with uniformly-charging performance. Another object of the invention is to provide a method of manufacturing the toner.

The invention provides a toner formed of aggregate of resin-containing particles which are obtained by finely granulating amorphous resin particles containing a binder resin, a colorant, a release agent, and a release agent-dispersing aid using a high-pressure homogenizer method, the resin-containing particles having a volume average particle diameter in a range of from 0.4 μm to 1.0 μm.

According to the invention, the toner is an aggregate of resin-containing particles which are obtained by finely granulating amorphous resin particles containing a binder resin, a colorant, a release agent, and a release agent-dispersing aid using a high-pressure homogenizer method, the resin-containing particles having a volume average particle diameter falls in a range of from 0.4 μm to 1.0 μm. The toner just described is enhanced in compatibility between the binder resin and the release agent by virtue of the release agent-dispersing aid contained therein as a toner raw material, which contributes to dispersion of the release agent into the binder resin. In the toner, the release agent is thus dispersed finely in the binder resin of the resin-containing particles which are obtained by finely granulating the amorphous resin particles using the high-pressure homogenizer method.

When the high-pressure homogenizer method is employed to finely granulate the amorphous resin particles, the colorant and the release agent are included in the binder resin, with the result that the resin-containing particles can be easily obtained of which volume average particle diameter falls in a range of from 0.4 μm to 1.0 μm. Further, in the binder resin of the resin-containing particles obtained using the high-pressure homogenizer method, the colorant and the release agent are dispersed at a weight ratio which is substantially uniform for each particle. The toner formed of aggregate of the resin-containing particles as described above has a plurality of toner particles which are substantially uniform with each other in dispersibility of the colorant and the release agent, and in the toner, the colorant and the release agent are prevented from being exposed on surfaces of the particles. Further, in the binder resin is dispersed in a substantially even manner the release agent of which particle diameter is smaller than that of the resin-containing particles. This largely lowers possibility of bleeding out of the release agent and certainly prevents toner filming and offset phenomenon in a high-temperature range from arising.

Further, in the toner formed of aggregate of the resin-containing particles as described above, the colorant is dispersed in the binder resin at a substantially uniform weight ratio in a state where a particle diameter of the colorant is minute. This makes the charging performance of toner particles substantially uniform, thus enhancing the charging stability. By using the above-described toner to form an image, a toner image is enhanced in transfer efficiency from a photoreceptor to a recording medium, transfer efficiency from a photoreceptor to an intermediate medium, transfer efficiency from an intermediate medium to a recording medium, and the like element, with the result that the toner consumption can be reduced. Further, in this case, it is possible to prevent image defects such as image fogging which is caused by defective charging of the toner.

Accordingly, the toner formed of aggregate of the resin-containing particles as described above has a smaller amount of the colorant and the release agent exposed on the surface of the toner as compared to the case of the toner which is formed of aggregated particles of respective components such as particles of the binder resin, particles of the colorant, and particles of the release agent. This contributes to prevention of blocking which is caused by thermal aggregation of the toner inside the image forming apparatus, thus enhancing the preservation stability of the toner. Further, the toner just described exhibits uniformly-charging performance.

Furthermore, the smaller amount of the release agent exposed on the surface of the toner can lead to a decrease in the amount of the release agent detached from the toner. This can prevent a content rate of the release agent to the toner from being decreased to a level lower than a content rate of the release agent to the toner raw material. Accordingly, it is possible to obtain a toner whose content rate of the release agent is favorable by giving a favorable amount of the release agent to the toner raw material. The favorable content rate of the release agent in the toner allows an increase of a temperature at which no high-temperature offset phenomenon arises, thus resulting in a toner which has a wide non-offset region.

Further, the toner formed of aggregate of the resin-containing particles is obtained by finely granulating the amorphous resin particles containing the binder resin, the colorant, the release agent, and the release agent-dispersing aid. That is to say, the resin-containing particles can be manufactured in such a simple manner as to finely granulating the amorphous resin particles. Furthermore, the amorphous resin particles serving as a raw material of the resin-containing particles can also be manufactured, for example, in a commonly-used toner manufacturing method such as a pulverization method. It is thus possible to manufacture the resin-containing particles without a significant increase in cost. Moreover, nonuniform particle shapes of the amorphous resin particles lead to an advantage that it is easy to finely granulate the amorphous resin particles by external stress applied thereto. Consequently, the toner as described above can be manufactured in a production method which is simpler than, for example, a method of manufacturing an encapsulated toner by coating with the fine resin particles the aggregate of particles of respective components such as particles of the binder resin, particles of the colorant, and particles of the release agent.

Further, in the invention, it is preferable that the high-pressure homogenizer method comprises:

a pulverizing step of forming a heated and pressurized slurry containing resin-containing particles by passing a slurry of amorphous resin particles through a pressure-resistant nozzle under heat and pressure to pulverize the amorphous resin particles; and a cooling and depressurizing step of cooling down the slurry obtained at the pulverizing step and gradually depressurizing the slurry to a pressure level at which no bubbling is caused.

According to the invention, in the high-pressure homogenizer method including the pulverizing step and the cooling and depressurizing step, resin-containing particles are obtained of which volume average particle diameter is so small in a range of from 0.4 μm to 1.0 μm. This is because the slurry of the amorphous resin particles is made to pass through the pressure-resistant nozzle under heat and pressure so that the amorphous resin particles are pulverized, thus preparing the slurry of the resin-containing particles at the pulverizing step, and at the cooling and depressurizing step provided immediately after the pulverizing step, the above-stated slurry is then cooled down and depressurized to a pressure level at which no generation of bubbles (bubbling) is found. By so doing, the bubbling and thus coarsening of the resin-containing particles caused by reaggregation thereof in the slurry are prevented from occurring.

Further, in the invention, it is preferable that an aggregate of the resin-containing particles is heated.

According to the invention, the mutual adhesion of the resin-containing particles can be enhanced by heating the aggregate of the resin-containing particles further, thus preventing the generation of fine particles which is caused by dissociation of the aggregate of the binder-containing particles inside the image forming apparatus. Further, the toner can be formed into a substantial sphere by heating the aggregate of the resin-containing particles, with the result that the toner is further enhanced in the charging stability.

Further, in the invention, it is preferable that a content of the release agent is 5 parts by weight or more based on 100 parts by weight of the binder resin.

According to the invention, the content of the release agent is 5 parts by weight or more based on 100 parts by weight or more of the binder resin, and the content rate of the release agent is thus favorable enough to exhibit the sufficient releasing property with which the high-temperature offset can be prevented from arising.

Further, in the invention, it is preferable that a melting point of the release agent is 80° C. or less.

According to the invention, the melting point of the release agent is 80° C. or less. By using the toner which contains the release agent as just described, it is possible to prevent such a low-temperature offset phenomenon from occurring that the toner fails to be fixed onto a recording medium at a low temperature, and it is thus possible to fix the toner onto a recording medium at a low temperature. In the case where the toner can be fixed onto a recording medium at a low temperature, the power consumption of a fixing section for fixing a toner can be small in which a heating section such as a heater is used.

Further, in the invention, it is preferable that a shape factor SF1 falls in a range of from 100 to 150.

According to the invention, the shape factor SF1 falls in a range of from 100 to 150. In the case where the shape factor falls in the above range, the toner is in form of a substantial sphere. This makes it possible to reduce the amount of fine particles which are produced due to chips of the toner caused by stirring, as compared to the case of the amorphous toner.

The invention provides a method of manufacturing a toner, comprising:

a finely-granulating step of forming resin-containing particles having a volume average particle diameter in a range of from 0.4 μm to 1.0 μm by finely granulating amorphous resin particles containing a binder resin, a colorant, a release agent, and a release agent-dispersing aid; and an aggregating step of aggregating the resin-containing particles obtained at the finely-granulating step.

According to the invention, at the finely-granulating step, the amorphous resin particles containing the binder resin, the colorant, the release agent, and the release agent-dispersing aid are finely granulated to thereby obtain the resin-containing particles of which volume average particle diameter falls in a range of from 0.4 μm to 1.0 μm. Further, at the aggregating step, resin-containing particles obtained at the finely-granulating step are aggregated. A toner thus manufactured has a smaller amount of the release agent exposed on the surface of the toner and is excellent in the preservation stability and the anti-offset property, as compared to the toner formed of the aggregated particles of the binder resin, particles of the colorant, and particles of the release agent. Moreover, the toner just described can be manufactured in a production method which is simpler than, for example, a method of manufacturing an encapsulated toner by coating with the fine resin particles the aggregate of the resin-containing particles.

Further, in the invention, it is preferable that the method further comprises a heating step of heating an aggregate of the resin-containing particles obtained at the aggregating step, the resin-containing particles having a volume average particle diameter in a range of from 0.4 μm to 1.0 μm or less.

According to the invention, the heating step is further included, and in the heating step is heated the aggregate formed of the resin-containing particles of which volume average particle diameter falls in a range of from 0.4 μm to 1.0 μm, obtained at the aggregating step. This enhances the mutual adhesion of the resin-containing particles which form the toner, thus preventing the generation of fine particles which is caused by chipping of the toner inside the image forming apparatus. Further, the toner can be formed into a substantial sphere by heating the aggregate of the resin-containing particles, with the result that the toner is further enhanced in the charging stability.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
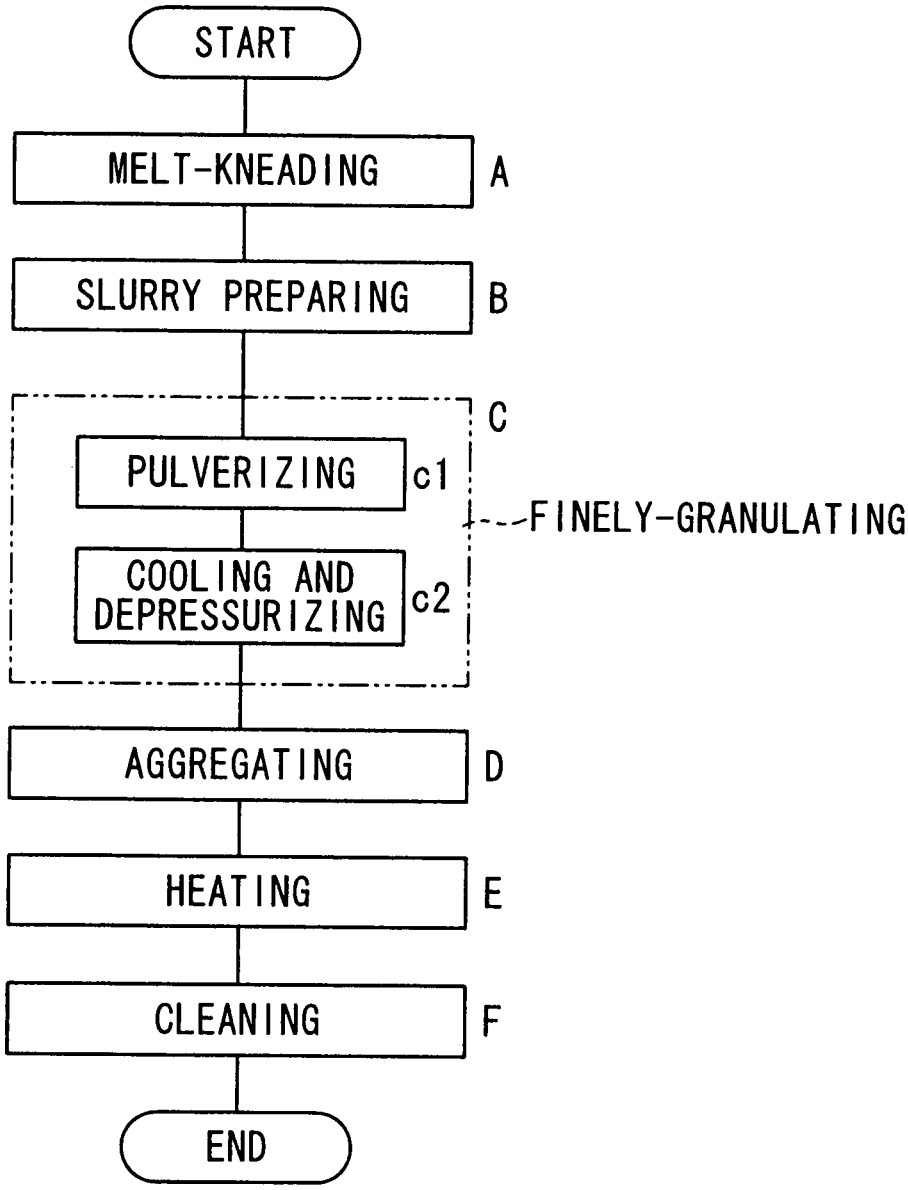
FIG. 1 is a flowchart for explaining a method of manufacturing a toner according to one embodiment of the invention.

Now referring to the drawings, preferred embodiments of the invention are described below.

A toner of the invention is an aggregate which is obtained by finely granulating amorphous resin particles containing a binder resin, a colorant, a release agent, and a release agent-dispersing aid using a high-pressure homogenizer method, the volume average particle diameter falling in a range of from 0.4 μm to 1.0 μm. The toner of the invention is used in an electrophotographic image forming apparatus including, for example, a copier, a laser beam printer, and a facsimile machine. The toner of the invention can be manufactured in a manufacturing method which includes, for example, (A) melt-kneading step, (B) slurry preparing step, (C) finely-granulating step, (D) aggregating step, (E) heating step, and (F) cleaning step. FIG. 1 is a flowchart for explaining one example of the method of manufacturing a toner of the invention.

(A) Melt-Kneading Step

At the melt-kneading step, a toner raw material containing a binder resin, a colorant, a release agent, and a release agent-dispersing aid is melt-kneaded to obtain a kneaded material which is then cooled and solidified, followed by pulverization and according to need, classification, thus manufacturing the amorphous resin particles.

Examples of the binder resin include acrylic resin, polyester, polyurethane, and epoxy resin. The acrylic resin is easily pulverized at a pulverizing stage of the later-described finely-granulating step, and a use thereof is therefore particularly favorable. As the acrylic resin, the selection of ingredients is not particularly limited, and acidic group-containing acrylic resin can be preferably used. The acidic group-containing acrylic resin can be produced, for example, by polymerization of acrylic resin monomers or polymerization of acrylic resin monomer and vinylic monomer with concurrent use of acidic group- or hydrophilic group-containing acrylic resin monomer and/or acidic group- or hydrophilic group-containing vinylic monomer. As the acrylic resin monomer, heretofore known ingredients can be used, including acrylic acid which may have a substituent, methacrylic acid which may have a substituent, acrylic acid ester which may have a substituent, and methacrylic acid ester which may have a substituent.

Specific examples of the acrylic resin monomer include: monomers of acrylic esters such as methyl acrylate, ethyl acrylate, isopropyl acrylate, n-butyl acrylate, isobutyl acrylate, n-amyl acrylate, isoamyl acrylate, n-hexyl acrylate, 2-ethylhexyl acrylate, n-octyl acrylate, decyl acrylate, and dodecyl acrylate; monomers of methacrylic esters such as methyl methacrylate, propyl methacrylate, n-butyl methacrylate, isobutyl methacrylate, n-amyl methacrylate, n-hexyl methacrylate, 2-ethylhexyl methacrylate, n-octyl methacrylate, decyl methacrylate, and dodecyl methacrylate; and hydroxyl group-containing monomers of (meth)acrylic esters such as hydroxyethyl acrylate and hydroxypropyl methacrylate. One of the above acrylic resin monomers may be used each alone, or two or more of the above acrylic resin monomers may be used in combination.

Moreover, as the vinylic monomer, heretofore known ingredients can be used, including styrene, α-methylstyrene, vinyl bromide, vinyl chloride, vinyl acetate, acrylonitrile, and methacrylonitrile. One of the above vinylic monomers may be used each alone, or two or more of the above vinylic monomers may be used in combination. The polymerization is effected by use of a commonly-used radical initiator in accordance with a solution polymerization method, a suspension polymerization method, an emulsification polymerization method, or the like method.

Polyester is excellent in transparency and capable of providing the obtained toner particles with favorable powder flowability, low-temperature fixing property, and secondary color reproducibility, thus being suitably used, in particular, as a binder resin for a color toner. As polyester, heretofore known ingredients can be used, including a polycondensation of polybasic acid and polyhydric alcohol. As polybasic acid, those known as monomers for polyester can be used, including: aromatic carboxylic acids such as terephthalic acid, isophthalic acid, phthalic acid anhydride, trimellitic acid anhydride, pyromellitic acid, and naphthalene dicarboxylic acid; aliphatic carboxylic acids such as maleic acid anhydride, fumaric acid, succinic acid, alkenyl succinic anhydride, and adipic acid; and a methyl-esterified compound of these polybasic acids. One of the above polybasic acids may be used each alone, or two or more of the above polybasic acids may be used in combination.

As polyhydric alcohol, those known as monomers for polyester can also be used, including: aliphatic polyhydric alcohols such as ethylene glycol, propylene glycol, butane diol, hexane diol, neopentyl glycol, and glycerin; alicyclic polyhydric alcohols such as cyclohexane diol, cyclohexane dimethanol, and hydrogenated bisphenol A; and aromatic diols such as an ethylene oxide adduct of bisphenol A and a propylene oxide adduct of bisphenol A. One of the above polyhydric alcohols may be used each alone, or two or more of the above polyhydric alcohols may be used in combination.

Polycondensation reaction of polybasic acid and polyhydric alcohol can be effected in a common manner. For example, the polycondensation reaction is effected by contacting polybasic acid and polyhydric alcohol each other in the presence or absence of an organic solvent and under the presence of a polycondensation catalyst, and terminated at the instant when the acid value and the softening temperature of the resultant polyester stand at predetermined values. Polyester is thus obtained. In the case of using the methyl-esterified compound of polybasic acid as a part of polybasic acid, a de-methanol polycondensation reaction takes place. In the polycondensation reaction, by properly changing the blending ratio, the reaction rate, or other factors as to the polybasic acid and the polyhydric alcohol, it is possible to adjust, for example, the terminal carboxyl group content of polyester and thus denature a property of the resultant polyester. Further, in the case of using trimellitic anhydride as polybasic acid, the denatured polyester can be obtained also by facile introduction of a carboxyl group into a main chain of polyester. Further, polyester may be grafted with acrylic resin.

As polyurethane, heretofore known ingredients can be used, and acidic group- or basic group-containing polyurethane can be preferably used, for example. The acidic group- or basic group-containing polyurethane can be produced in accordance with a heretofore known method, for example, by addition polymerization of acidic group- or basic group-containing diol, polyol, and polyisocyanate. Examples of the acidic group- or basic group-containing diol include dimethylol propionic acid and N-methyl diethanol amine. Examples of the polyol include polyether polyol such as polyethylene glycol, and polyester polyol, acryl polyol, and polybutadiene polyol. Examples of the polyisocyanate include tolylene diisocyanate, hexamethylene diisocyanate, and isophorone diisocyanate. One of the above components may be used each alone, or two or more of the above components may be used in combination.

As the epoxy resin, the selection of ingredients is not particularly limited, and acidic group- or basic group-containing epoxy resin can be preferably used. The acidic group- or basic group-containing epoxy resin can be produced, for example, by addition or addition polymerization of polyvalent carboxylic acid such as adipic acid and trimellitic acid anhydride or amine such as dibutyl amine and ethylene diamine to epoxy resin which serves as a base.

Among these binder resins, taking account of facilitation of finely-granulating operation, a kneading property with the colorant and the release agent, and equalization of shape and size of toner particles, it is preferable to use a binder resin having a softening temperature of 150° C. or lower, and particularly preferable to use a binder resin having a softening temperature of 60° C. to 150° C. Among such binder resins, preferred is a binder resin of which weight-average molecular weight falls in a range of from 5,000 to 500,000. One of the above binder resins may be used each alone, or two or more of the above binder resins may be used in combination. Furthermore, it is possible to use a plurality of resins of the same type, which are different in any one or all of molecular weight, monomer composition, and other factors.

As the colorant, it is possible to use an organic dye, an organic pigment, an inorganic dye, and an inorganic pigments, which are commonly used in the electrophotographic field. Black colorants include, for example, carbon black, copper oxide, manganese dioxide, aniline black, activated carbon, non-magnetic ferrite, magnetic ferrite, and magnetite.

Yellow colorants include, for example, yellow lead, zinc yellow, cadmium yellow, yellow iron oxide, mineral fast yellow, nickel titanium yellow, navel yellow, naphthol yellow S, hanza yellow G, hanza yellow 10G, benzidine yellow G, benzidine yellow GR, quinoline yellow lake, permanent yellow NCG, tartrazine lake, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, and C.I. pigment yellow 138.

Orange colorants include, for example, red lead yellow, molybdenum orange, permanent orange GTR, pyrazolone orange, vulcan orange, indanthrene brilliant orange RK, benzidine orange G, indanthrene brilliant orange GK, C.I. pigment orange 31, and C.I. pigment orange 43.

Red colorants include, for example, red iron oxide, cadmium red, red lead oxide, mercury sulfide, cadmium, permanent red 4R, lysol red, pyrazolone red, watching red, calcium salt, lake red C, lake red D, brilliant carmine 6B, eosin lake, rhodamine lake B, alizarin lake, brilliant carmine 3B, C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 166, C.I. pigment red 177, C.I. pigment red 178, and C.I. pigment red 222.

Purple colorants include, for example, manganese purple, fast violet B, and methyl violet lake.

Blue colorants include, for example, Prussian blue, cobalt blue, alkali blue lake, Victoria blue lake, phthalocyanine blue, non-metal phthalocyanine blue, phthalocyanine blue-partial chlorination product, fast sky blue, indanthrene blue BC, C.I. pigment blue 15, C.I. pigment blue 15:2, C.I. pigment blue 15:3, C.I. pigment blue 16, and C.I. pigment blue 60.

Green colorants include, for example, chromium green, chromium oxide, pigment green B, malachite green lake, final yellow green G, and C.I. pigment green 7.

White colorants include, for example, those compounds such as zinc white, titanium oxide, antimony white, and zinc sulfide. One of the above colorants may be used each alone, or two or more of different colors of the above colorants may be used in combination. Further, two or more of the colorants of the same color may be used in combination. A usage of the colorant is not limited to a particular amount, and a preferable usage thereof is 3 parts by weight to 10 parts by weight based on 100 parts by weight of the binder resin.

The colorant is preferably used in form of master batch. The master batch of a colorant can be manufactured, for example, by kneading a synthetic resin and the colorant. The usable synthetic resin is a binder resin of the same sort as the binder resin used as the toner raw material, or resin which is well-compatible with the binder resin used as the toner raw material. A use ratio of the colorant to the synthetic resin is not limited to a particular ratio, and a preferable use ratio of the colorant falls in a range of from 30 parts by weight to 100 parts by weight based on 100 parts by weight of the synthetic resin. Before used, the master batch has been granulated so as to have a particle diameter of around 2 mm to 3 mm, for example. In the case of using the colorant in form of the master batch, the dispersibility of the colorant into the binder resin is enhanced so that the colorant can be finely dispersed in the resin-containing particles which are obtained at the later-described finely-granulating step.

Examples of the release agent include wax. The wax includes, for example: natural wax such as carnauba wax and rice wax; synthetic wax such as polypropylene wax, polyethylene wax, and Fischer-Tropsch wax; coal wax such as montan wax; petroleum wax such as paraffin wax; alcohol wax; and ester wax. One of the above release agents may be used each alone, or two or more of the above release agents may be used in combination.

A melting point of the release agent is preferably 80° C. or less. The melting point of the release agent over 80° C. will cause the release agent to fail to be melted on an attempt to fix the toner onto a recording medium under heating through a heating roller, possibly leading to the low-temperature offset phenomenon that the toner is not fixed onto the recording medium. It is thus possible to prevent the low-temperature offset phenomenon from arising by using the release agent having a melting point of 80° C. or less. Further, the melting point of the release agent equal to 80° C. or less will result in a decrease of softening temperature of the toner as a whole, thus enhancing the low-temperature fixing property. This makes it possible to reduce the power consumption of the fixing section which is used for fixing through the heating section such as a heater.

Moreover, it is further preferred that the melting point of the release agent fall in a range of from 60° C. to 80° C. The melting point of the release agent less than 60° C. will cause the release agent to be melted at the melt-kneading step, thus making a larger difference between viscosity of the release agent and viscosity of the binder resin, which may cause difficulty in dispersing the release agent into the binder resin. In addition, the toner particles may be aggregated with each other inside the image forming apparatus, possibly leading to a decrease in the preservation stability. Accordingly, the use of the release agent having a melting point in a range of from 60° C. to 80° C. makes it possible to obtain a toner which is excellent in the preservation stability with the release agent evenly dispersed in the binder resin and which can prevent the low-temperature offset phenomenon from arising.

A content of the release agent preferably falls in a range of from 3 parts by weight to 15 parts by weight based on 100 parts by weight of the binder resin. The content of the release agent less then 3 parts by weight will not sufficiently bring the releasing property out, possibly causing the high-temperature offset phenomenon to appear. The content of the release agent over 15 parts by weight may cause the toner filming that the release agent forms a thin coating on a photoreceptor surface. It is thus possible to prevent the toner filming and the high-temperature offset from arising by setting the ratio of the release agent in a range of from 3 parts by weight to 15 parts by weight based on 100 parts by weight of the binder resin. Moreover, it is further preferred that the content of the release agent fall in a range of from 5 parts by weight to 15 parts by weight based on 100 parts by weight of the binder resin. Such a content of the release agent will certainly prevent the toner filming and the high-temperature offset phenomenon from arising.

Further, the toner of the invention is characterized in containing a release agent-dispersing aid (which may be simply referred to as "dispersing aid" hereinafter). A usable dispersing aid is an ingredient whose property makes the binder resin and the release agent compatible with each other.

The dispersing aid is preferably compatible with both of the binder resin and the release agent. Such a dispersing aid includes, for example, a copolymer composed of a part which is excellent in compatibility with the wax and a part which is excellent in compatibility with the binder resin.

As the copolymer composed of the part which is excellent in compatibility with the wax and the part which is excellent in compatibility with the binder resin, it is possible to use as the dispersing aid, for example, a copolymer composed of: a polyolefin part formed of polyethylene and the like substance which is excellent in compatibility with the wax; and a vinyl polymer part formed of polystyrene, styrene-acrylic resin, and the like substance which is excellent in compatibility with the binder resin. The copolymer as just described includes, for example, a styrene-ethylene-butadiene block copolymer, a styrene-methyl methacrylate block copolymer, an ethylene-styrene graft copolymer, maleic anhydride modified polypropylene, and a styrene-maleic anhydride copolymer.

It is also possible to use a commercially-available ingredient as the dispersing aid. The usable dispersing aid includes, for example, Ceramer 1608 (trade name) and Ceramer 1251 (trade name) which are manufactured by Toyo-Petrolite Co., Ltd. The Ceramer 1608 and Ceramer 1251 are each a copolymer of an α-olefin-maleic anhydride copolymer and maleic anhydride monoester.

A ratio of the dispersing aid contained in the toner raw material preferably falls in a range of from 1 part by weight to 10 parts by weight, and further preferably falls in a range of from 2 parts by weight to 3 parts by weight, based on 100 parts by weight of the binder resin. Such a content ratio of the dispersing aid will allow the dispersing aid to exhibit compatibility with both of the binder resin and the release agent so that the release agent can be evenly dispersed into the binder resin. When the ratio of the dispersing aid is less than 1 part by weight based on 100 parts by weight of the binder resin, the content of the dispersing aid is small based on an amount of the binder resin and an amount of the release agent which is to be dispersed into the binder resin, with the result that the binder resin and the release agent are less compatible with each other, possibly causing the release agent not to be sufficiently dispersed into the binder resin. The ratio of the dispersing aid over 10 parts by weight based on 100 parts by weight of the binder resin may change the innate characteristics of the binder resin.

Moreover, it is further preferred that the dispersing aid contained in the toner raw material at the favorable ratio as stated above satisfy a ratio in a range of from 0.1 part by weight to 10 parts by weight based on 1 part by weight of the release agent. The ratio of the dispersing aid less than 0.1 part by weight based on 1 part by weight of the release agent means that the content of the dispersing aid is small relative to the content of the release agent, which may not prevent the release agent from being aggregated. The ratio of the dispersing aid over 10 parts by weight based on 1 part by weight of the release agent may cause the release agent to be too dispersed into the binder resin. When the release agent is too dispersed in the binder resin, a dispersed particle diameter of the release agent is too small, which may not bring out the sufficient anti-offset property.

Further, to the toner raw material, an additive such as a charge control agent may be added. The usable charge control agent includes a positive charge control agent and a negative charge control agent which are commonly used in the electrophotographic field. The positive charge control agent includes, for example, a basic dye, quaternary ammonium salt, quaternary phosphonium salt, aminopyrine, a pyrimidine compound, a polynuclear polyamino compound, aminosilane, a nigrosine dye, a derivative thereof, a triphenylmethane derivative, guanidine salt, and amidine salt. The negative charge control agent includes oil-soluble dyes such as oil black and spiron black, a metal-containing azo compound, an azo complex dye, metal salt naphthenate, salicylic acid, metal complex and metal salt (the metal includes chrome, zinc, and zirconium) of a salicylic acid derivative, a fatty acid soap, long-chain alkylcarboxylic acid salt, and a resin acid soap. One of the above charge control agents may be used each alone and according to need, two or more of the above agents may be used in combination. A usage of the charge control agent is not limited to a particular level and may be selected as appropriate from a wide range. A preferable usage of the charge control agent falls in a range of from 0.5 part by weight to 3 parts by weight based on 100 parts by weight of the binder resin.

At the melt-kneading step, the toner raw material is firstly dry-mixed by a mixer. The toner raw material contains, as stated above, the binder resin, the colorant, the release agent, and the dispersing aid, and when necessary, the additive such as the charge control agent which is to be added for controlling the toner charging performance. The toner raw material is then heated to a temperature which is a softening temperature of the binder resin or higher and less than a decomposition temperature of the binder resin, thereafter being melt-kneaded. The binder resin is thereby softened so that the colorant, the release agent, and the like ingredient are dispersed into the binder resin. A specific heating temperature at the melt-kneading occasion is, for example, around 80° C. to 200° C., and preferably around 100° C. to 150° C. Although the toner raw material containing the binder resin, the colorant, the release agent, and the dispersing aid does not have to be dry-mixed before melt-kneaded, the dry-mixing operation is preferably performed before the melt-kneading operation because the melt-kneading operation followed by the dry-mixing operation will enhance the dispersibility into the binder resin, of the toner raw material such as the colorant and the release agent except the binder resin so that a resultant toner can exhibit a uniform property such as the toner charging performance.

The mixers usable for the dry-mixing operation include, for example, Henschel-type mixing apparatuses such as a Henschel mixer (trade name) manufactured by Mitsui Mining Co., a super mixer (trade name) manufactured by Kawata Co., and a MECHANO mill (trade name) manufactured by Okada Seiko Co., Ltd., ONG mill (trade name) manufactured by Hosokawa Micron Co., Hybridization system (trade name) manufactured by Nara Machinery Co., Ltd., and Cosmo system (trade name) manufactured by Kawasaki Heavy Industry Co., Ltd.

For melt-kneading, it is possible to use kneading machines such as a kneader, a twin-screw extruder, a two roll mill, a three roll mill, and laboplast mill. Specific examples of such kneading machines include single or twin screw extruders such as TEM-100B (trade name) manufactured by Toshiba Kikai Co., Ltd., PCM-65/87 and PCM-30, both of which are trade names and manufactured by Ikegai Co., and open roll-type kneading machines such as Kneadics (trade name) manufactured by Mitsui Mining Co. The melt-kneading operation may be conducted by using a plurality of the kneading machines.

At the melt-kneading step, the toner raw material which contains the dispersing aid together with the binder resin and the release agent is melt-kneaded, with the result that the interfacial tension between the binder resin and the release agent can be smaller than that in the case where the dispersing aid is not contained in the toner raw material. The binder resin and the release agent can be thus made compatible with each other, which prevents the release agent from being aggregated, so that the release agent can remain sufficiently small in particle diameter relative to a resin-containing particle (having a particle diameter of 0.4 μm to 1.0 μm) which is to be manufactured, therefore being evenly dispersed in the binder resin. By dispersing into the binder resin the release agent having a sufficiently small particle diameter at the melt-kneading step as described above, it is possible to obtain, at the later-described finely-granulating step, resin-containing particles in which the release agent is evenly dispersed in the binder resin.

The melt-kneaded material obtained at the melt-kneading step, which contains the binder resin, the colorant, the release agent, and the release agent-dispersing aid, is cooled and solidified, thereafter being coarsely pulverized into amorphous resin particles. In the present embodiment, at the finely-granulating step, the amorphous resin particles are pulverized into particles of which volume average particle diameter is 0.4 μm to 1.0 μm in a state of slurry that the amorphous resin particles are mixed with a liquid. For example, in the case of using the high-pressure homogenizer to finely granulate the amorphous resin particles, some blocky amorphous resin particles contained in the slurry may not pass through a nozzle.

Accordingly, the melt-kneaded material needs to be coarsely pulverized in advance before the finely-granulating step so as to obtain preferably-sized amorphous resin particles. A degree how far the melt-kneaded material is coarsely pulverized depends on a type of the high-pressure homogenizer, and it is preferred that the melt-kneaded material be coarsely pulverized until the volume average particle diameter of the amorphous resin particles becomes around 100 μm. A too large volume average particle diameter over 100 μm will increase a sedimentation rate of the amorphous resin particles in the slurry, thus causing difficulty in maintaining the uniform dispersion state of the amorphous resin particles. In addition, the treatment does not need to dare have the increased number of steps for attaining such an excessively small volume average particle diameter of the amorphous resin particles as a size less than 100 μm. No particular limitation is imposed on a method of coarsely pulverizing the melt-kneaded material. The melt-kneaded material is coarsely pulverized by using, for example, a crusher, a hammer mill, an atomizer, a feather mill, and a jet mill. Further, it is also possible to coarsely pulverize the amorphous resin particles by letting through the pressure-resistant nozzle the slurry obtained at the following slurry preparing step.

(B) Slurry Preparing Step

At the slurry preparing step, the amorphous resin particles which are formed by coarsely pulverizing the melt-kneaded material obtained at the melt-kneading step, is mixed with a liquid so that the amorphous resin particles are dispersed in the liquid, whereby slurry of the amorphous resin particles is prepared.

The liquid being mixed with the amorphous resin particles is not limited to a particular liquid as long as the liquid allows the amorphous resin particles to be not dissolved therein but evenly dispersed therein. In view of ease of the controls over the steps and the waste liquid disposal after completion of all the steps, water is preferably selected as the liquid, and more preferable is water containing a dispersion stabilizer, and particularly preferable is water containing a dispersion stabilizer and a surfactant. The dispersion stabilizer has been preferably added to water in advance before the amorphous resin particles are added to the water. A usage of the dispersion stabilizer is not limited to a particular amount, and the usage is preferably 0.05% to 15% by weight and more preferably 1% to 10% by weight, of a total amount of the amorphous resin particles and the dispersion stabilizer. The usage of the dispersion stabilizer which is to be contained in the water together with the surfactant is the same as that is to be contained in the water without the surfactant.

As the dispersion stabilizer, it is possible to use any ingredients which are commonly used in this field and among which a water-soluble polymeric dispersant is preferable. Examples of the water-soluble polymeric dispersant include (meth)acrylic polymer, polyoxyethylene polymer, cellulose polymer, polyoxyalkylene alkylarylether sulfate salt, and polyoxyalkylene alkylether sulfate salt. The (meth)acrylic polymer includes one or two hydrophilic monomers selected from: acrylic monomers such as (meth)acrylic acid, α-cyanoacrylate, α-cyanomethacrylate, itaconic acid, crotonic acid, fumaric acid, maleic acid, and maleic acid anhydride; hydroxyl-containing acrylic monomers such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, and 3-chloro-2-hydroxypropyl methacrylate; ester monomers such as diethylene glycol monoacrylic ester, diethylene glycol monomethacrylic ester, glycerine monoacrylic ester, and glycerine monomethacrylic ester; vinyl alcohol monomers such as N-methylol acrylamide and N-methylol methacrylamide; vinylalkylether monomers such as vinylmethylether, vinylethylether, and vinylpropylether; vinylalkylester monomers such as vinyl acetate, vinyl propionate, and vinyl butyrate; aromatic vinyl monomers such as styrene, α-methylstyrene, and vinyl toluene; amide monomers such as acrylamide, methacrylamide, diacetone acrylamide, and methylol compounds thereof; nitrile monomers such as acrylonitrile and methacrylonitorile; acid chloride monomers such as chloride acrylate and chloride methacrylate; vinyl nitrogen-containing heterocyclic monomers such as vinylpyridine, vinylpyrrolidone, vinylimidazole, and ethyleneimine; and cross-linking monomers such as ethyleneglycol dimethacrylate, diethyleneglycol dimethacrylate, allyl methacrylate, and divinylbenzene.

The polyoxyethylene polymer includes polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylphenylester, and polyoxyethylene nonylphenylester.

The cellulose polymer includes methylcellulose, hydroxyethylcellulose, and hydroxypropylcellulose.

The polyoxyalkylene alkylarylether sulfate salt includes sodium polyoxyethylene laurylphenylether sulfate, potassium polyoxyethylene laurylphenylether sulfate, sodium polyoxyethylene nonylphenylether sulfate, sodium polyoxyethylene oleylphenylether sulfate, sodium polyoxyethylene cetylphenylether sulfate, ammonium polyoxyethylene laurylphenylether sulfate, ammonium polyoxyethylene nonylphenylether sulfate, and ammonium polyoxyethylene oleylphenylether sulfate.

The polyoxyalkylene alkylether sulfate salt includes sodium polyoxyethylene laurylether sulfate, potassium polyoxyethylene laurylether sulfate, sodium polyoxyethylene oleylether sulfate, sodium polyoxyethylene cetylether sulfate, ammonium polyoxyethylene laurylether sulfate, and ammonium polyoxyethylene oleylether sulfate. One of the above dispersion stabilizers may be used each alone, or two or more of the above dispersion stabilizers may be used in combination.

Examples of the surfactant include sodium dodecylbenzene sulfate, sodium tetradecyl sulfate, sodium pentadecyl sulfate, sodium octyl sulfate, sodium oleate, sodium laurylate, sodium stearate, and potassium stearate. One of the above surfactants may be used each alone, or two or more of the above surfactants may be used in combination.

The mixing of the amorphous resin particles and the liquid is conducted by use of a commonly-used mixer so that slurry of the amorphous resin particles is obtained. An addition amount of the amorphous resin particles relative to the liquid is not limited to a particular amount, and the amount of the amorphous resin particles is preferably 3% to 45% by weight and more preferably 5% to 30% by weight of a total amount of the amorphous resin particles and liquid. Furthermore, the mixing of the amorphous resin particles and water may be conducted under heating or cooling though usually conducted at a room temperature. Examples of the mixer include Henschel-type mixing apparatuses such as a Henschel mixer (trade name) manufactured by Mitsui Mining Co., Ltd., a super mixer (trade name) manufactured by Kawata Co., Ltd., and a MECHANO mill (trade name) manufactured by Okada Seiko Co., Ltd., ONG mill (trade name) manufactured by Hosokawa Micron Co., Ltd., Hybridization system (trade name) manufactured by Nara Machinery Co., Ltd., and Cosmo system (trade name) manufactured by Kawasaki Heavy Industry Co., Ltd.

(C) Finely-Granulating Step

The slurry of the amorphous resin particles obtained at the slurry preparing step is then treated at the finely-granulating step. At the finely-granulating step, the amorphous resin particles containing the binder resin, the colorant, the release agent, and the release agent-dispersing aid is finely granulated, thereby obtaining the resin-containing particles of which volume average particle diameter falls in a range of from 0.4 μm to 1.0 μm. The finely-granulating operation of the amorphous resin particles is conducted in accordance with the high-pressure homogenizer method. The finely-granulating step in accordance with the high-pressure homogenizer method includes a pulverizing stage as Step c1 and a cooling and depressurizing stage as Step c2.

The high-pressure homogenizer method herein indicates a method in which a high-pressure homogenizer is used for micronizing or granulating the resin-containing particles which contain synthetic resin, a release agent, and the like ingredients. The high-pressure homogenizer herein indicates an apparatus for pulverizing the particles under pressure. The usable high-pressure homogenizer includes those available on the market or those described in patent publications. Examples of the commercially available high-pressure homogenizer include chamber-type high-pressure homogenizers such as Micofluidizer (trade name) manufactured by Microfluidics Corporation, Nanomizer (trade name) manufactured by Nanomizer Inc., and Ultimizer (trade name) manufactured by Sugino Machine Ltd., High-pressure homogenizer (trade name) manufactured by Rannie Inc., High-pressure homogenizer (trade name) manufactured by Sanmaru Machinery Co., Ltd., and High-pressure homogenizer (trade name) manufactured by Izumi Food Machinery Co., Ltd. Further, examples of the high-pressure homogenizer described in patent publications include a high-pressure homogenizer disclosed in WO03/059497. Among the above homogenizers, preferred is the high-pressure homogenizer disclosed in WO03/059497.

Figure 2:
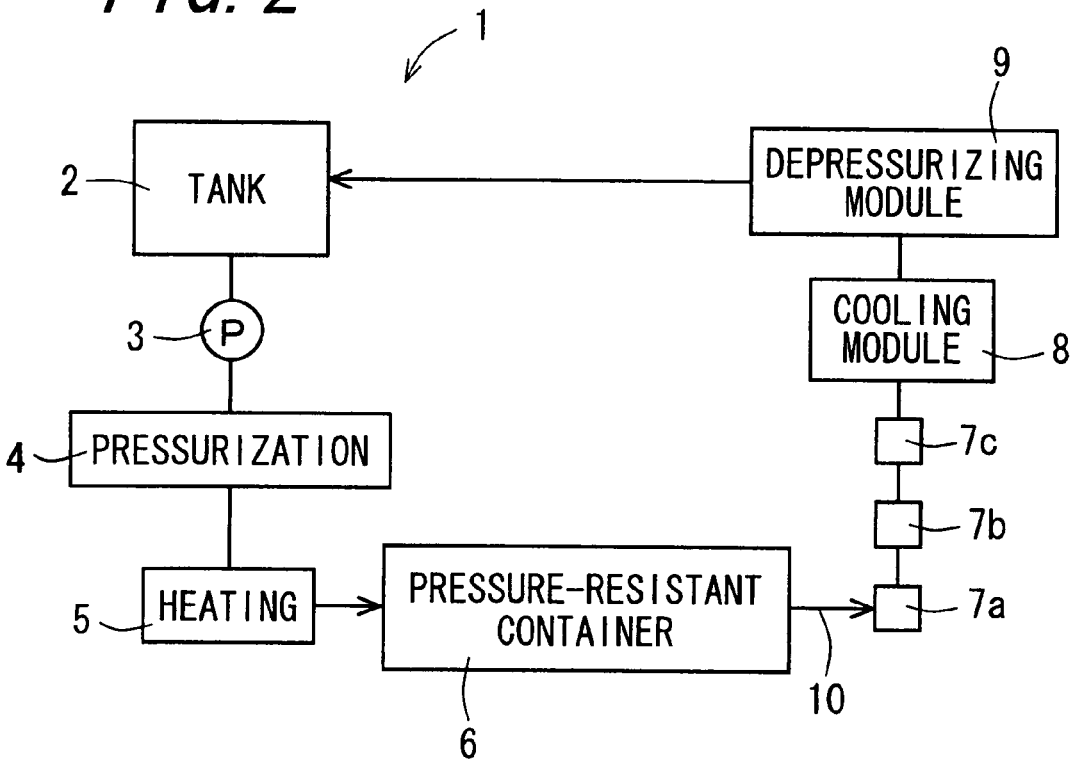
FIG. 2 is a systematic chart schematically showing a high-pressure homogenizer which is favorably used at a finely-granulating step in a method of manufacturing a toner according to one embodiment of the invention.

FIG. 2 is a systematic chart schematically showing the high-pressure homogenizer which is favorably used at the finely-granulating step in a method of manufacturing a toner of the invention. The high-pressure homogenizer 1 includes a tank 2, a feeding pump 3, a pressurizing unit 4, a heating unit 5, a pressure-resistant container 6, a first pressure-resistant nozzle 7*a*, a second pressure-resistant nozzle 7*b*, a third pressure-resistant nozzle 7*c*, and a cooling module 8, a depressurizing module 9, and a piping 10. A direction of an arrow put on the piping 10 indicates a direction in which the slurry flows.

The high-pressure homogenizer 1 is composed of the tank 2, the feeding pump 3, the pressurizing unit 4, the heating unit 5, the pressure-resistant container 6, the first pressure-resistant nozzle 7*a*, the second pressure-resistant nozzle 7*b*, the third pressure-resistant nozzle 7*c*, the cooling module 8, the depressurizing module 9 which are disposed in sequence according to the order that the slurry flows.

At the finely-granulating step, the tank 2 contains the slurry of the amorphous resin particles. It is preferred that a stirring device for stirring the slurry be provided inside the tank 2. The slurry of the amorphous resin particles contained in the tank 2 is fed into the piping 10 by the feeding pump 3. The fed slurry of the particles is pressurized by the pressurizing unit 4 and heated by the heating unit 5.

The pressurizing unit 4 is composed of, for example, a plunger pump having a plunger and a pump part which is driven for charging and discharging by the plunger. The heating unit 5 is composed of, for example, a heating furnace having a heating section such as a coil for heating the piping 10 through which the slurry flows. Conditions for pressurizing and heating will be described in detail hereinbelow. The slurry which has been pressurized by the pressurizing unit 4 and heated by the heating unit 5 is fed to the pressure-resistant container 6.

The pressure-resistant container 6 is an airtight container which is resistant to pressure. It is preferred that the pressure-resistant container 6 have a stirring device for stirring the slurry contained in the pressure-resistant container 6.

At the pulverizing stage of the finely-granulating step, the slurry fed to the pressure-resistant container 6*b* passes through the first to third pressure-resistant nozzles 7*a*, 7*b*, and 7*c* via the piping 10, thus being pulverized. Hereinafter, the first to third pressure-resistant nozzles 7*a*, 7*b*, and 7*c* will be simply referred to as a pressure-resistant nozzle 7 unless otherwise a particular pressure-resistant nozzle is specified.

As the pressure-resistant nozzle 7, it is possible to use a commonly-used pressure-resistant nozzle through which a liquid can flow. A preferably-used pressure-resistant nozzle 7 is, for example, a multiple nozzle which has a plurality of liquid flowing passages. The liquid flowing passages of the multiple nozzle may be arranged in form of a concentric circle of which center is a shaft of the multiple nozzle. Alternatively, the liquid flowing passages may be arranged in substantially parallel with a longitudinal direction of the multiple nozzle. One example of the multiple nozzle being used in the manufacturing method of the invention is a nozzle having one or a plurality of liquid flowing passages, preferably having around one or two liquid passages, each of which is around 0.05 mm to 0.35 mm in inlet diameter and outlet diameter and 0.5 cm to 5 cm in length. Further, an example of the pressure-resistant nozzle is shown in FIG. 3.

Figure 3:
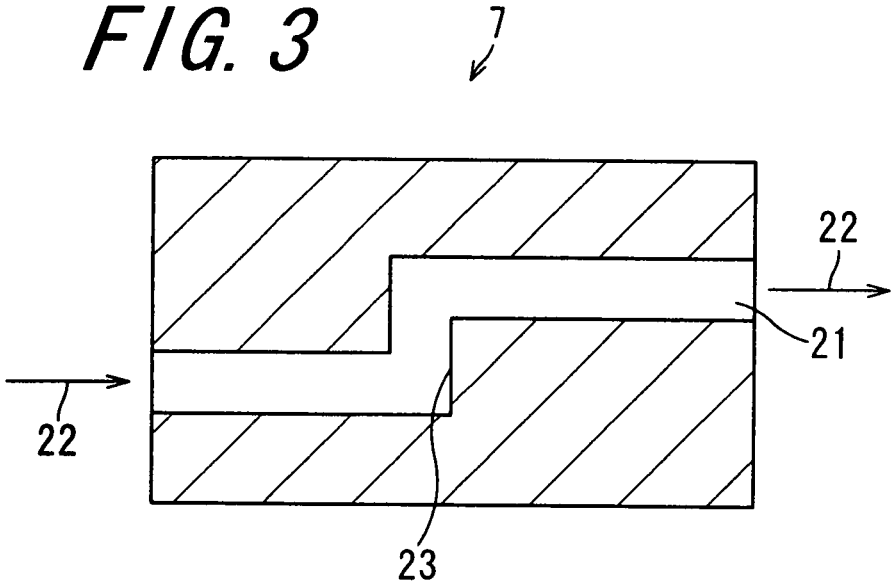
FIG. 3 is a sectional view schematically showing a configuration of a pressure-resistant nozzle.

FIG. 3 is a sectional view schematically showing a configuration of the pressure-resistant nozzle 7. The pressure-resistant nozzle 7 has a liquid flowing passage 21 therein. The liquid flowing passage 21 is bent to thus form a hook shape and therefore provided with at least one collision wall 23 against which the slurry of particles flows in an arrow 22 direction into the liquid flowing passage 21. The slurry containing the particles collides against the collision wall 23 at a substantially right angle, whereby the particles are pulverized into smaller particles which are then discharged from the pressure-resistant nozzle 7. The use of the pressure-resistant nozzle 7 having the liquid flowing passage 21 as described above allows the particles to be stably made smaller in diameter and moreover makes it possible to prevent the diameter-reduced particles from coming into contact with each other so as not to be aggregated and coarsened. Although an inlet and an outlet of the pressure-resistant nozzle 7 are formed into the same size in the present embodiment, no limitation is imposed on the configuration which may be therefore formed so that the outlet is smaller than the inlet in diameter. In addition, although three pressure-resistant nozzles 7 are coupled on each other in the present embodiment, the configuration is not limited to the above and there may be one pressure-resistant nozzle 7 or two or more pressure-resistant nozzles 7 which are coupled on each other.

The slurry of the diameter-reduced resin-containing particles discharged from the pressure-resistant nozzle 7 is introduced into the cooling module 8 and cooled down therein which has a cooling gradient, followed by being discharged from the cooling module 8. The number of the cooling module 8 being disposed may be one or plural.

The cooling module 8 is a commonly-used liquid cooling machine which has a pressure-resistant structure. The usable cooling module 8 is, for example, a cooling machine for water-cooling the piping 10 through which the slurry flows. Preferably used as the cooling module 8 is a cooling machine which has a large cooling area, such as a corrugated tube-type cooling machine. Further, the cooling machine is preferably configured so that a cooling gradient is smaller (or cooling ability is lowered) from an inlet to an outlet of the cooling machine. This is because such a configuration contributes to more effective achievements of reduction in diameter of the resin-containing particles. Further, by so doing, it is possible to prevent the resin-containing particles from being reattached to each other, thus causing no coarsening of the resin-containing particles to thereby enhance the yield of the diameter-reduced resin-containing particles. The slurry discharged from the cooling module 8 is introduced into the depressurizing module 9.

As the depressurizing module 9, it is preferable to use a multistage depressurization apparatus disclosed in WO03/059497. The multistage depressurization apparatus is composed of an inlet passage for leading pressurized slurry containing resin-containing particles into the multistage depressurization apparatus, an outlet passage in communication with the inlet passage, for discharging the depressurized slurry containing resin-containing particles to outside of the multistage depressurization apparatus, and a multistage depressurization section disposed between the inlet passage and the outlet passage, on which two or more depressurizing members are coupled via coupling members. The depressurizing member used for the multistage depressurization section in the multistage depressurization apparatus includes a pipe-shaped member, for example. The coupling member includes a ring-shaped seal, for example. The multistage depressurization section is configured by coupling a plurality of the pipe-shaped members having different inner diameters on each other by the ring-shaped seals. For example, two to four pipe-shaped members having the same inner diameters are coupled on each other from the inlet passage toward the outlet passage. On these pipe-shaped members is then coupled one pipe-shaped member having an inner diameter which is about twice as large as the inner diameter of these pipe-shaped members. Furthermore, on those pipe-shaped members are coupled about one to three pipe-shaped members having an inner diameter which is about 5% to 20% smaller than the inner diameter of the one pipe-shaped member. By so doing, the slurry containing resin-containing particles, which flows inside the pipe-shaped members is gradually depressurized to a final pressure level at which no bubbling is caused, preferably to a level of air pressure. A heat exchanging section using a cooling medium or heating medium may be disposed around the multistage depressurization section so that cooling or heating is conducted in accordance with a level of pressure imparted to the slurry containing resin-containing particles. There may be one multistage depressurization apparatus or a plurality of the multistage depressurization apparatuses which may be disposed in series or in parallel. Further, an example of the depressurizing member of the depressurizing module 9 is shown in FIG. 4.

Figure 4:
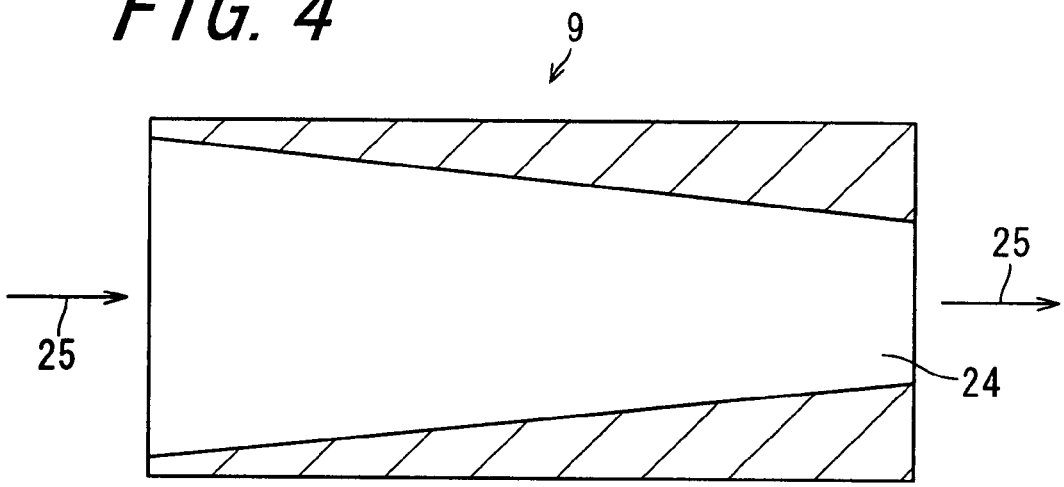
FIG. 4 is a sectional view schematically showing a configuration of a depressurizing member of a depressurization module.

FIG. 4 is a sectional view schematically showing a configuration of the depressurizing member of the depressurization module 9. The depressurizing member of the depressurization module 9 has a liquid flowing passage 24 therein. In forming the liquid flowing passage 24, an outlet is made smaller in diameter than an inlet. The slurry flows in an arrow 25 direction into the liquid flowing passage 24 and is depressurized while flowing through the liquid flowing passage 24. The slurry depressurized in the depressurizing module 9 then returns to the tank 2.

At the finely-granulating step, the high-pressure homogenizer 1 as described above is used for the pulverizing-stage indicated by Step c1 and the cooling and depressurizing stage indicated by Step c2.

At Step c1, i.e., at the pulverizing stage, the slurry of the amorphous resin particles obtained at the slurry preparing step is made to pass through the pressure-resistant nozzle 7 under heat and pressure. By so doing, the amorphous resin particles are pulverized, thereby obtaining slurry which contains the heated and pressurized resin-containing particles.

The amorphous resin particles in a state of slurry are contained in the tank 2. The slurry contained in the tank 2 is fed by the feeding pump 3, thereafter being pressurized by the pressurizing unit 4 and heated by the heating unit 5.

Conditions imposed on the pressurizing unit 4 and the heating unit 5 for pressurizing and heating the slurry of the amorphous resin particles are not limited to particular conditions. The slurry is preferably pressurized at 50 MPa to 250 MPa and heated to be 50° C. or more, and more preferably pressurized at 50 MPa to 250 MPa and heated to be a softening temperature of the amorphous resin particles, and furthermore preferably pressurized at 50 MPa to 250 MPa and heated to be a temperature between the softening temperature of the amorphous resin particles and a temperature which is 25° C.—higher than the softening temperature of the amorphous resin particles. The softening temperature of the amorphous resin particles represents a half of the softening temperature measured by a flow tester. Pressure below 50 MPa causes the shearing energy to be small, which possibly leads to insufficient reduction of the particle diameter. Pressure above 250 MPa excessively increases a degree of risk in an actual production line, thus being unrealistic. The slurry of the amorphous resin particles is introduced at a pressure and temperature falling in the above-stated ranges, from the inlet of the pressure-resistant nozzle into the pressure-resistant nozzle. In the present embodiment, the slurry of the amorphous resin particles is pressurized at 210 MPa and heat to be 120° C.

The slurry which has been pressurized by the pressurizing unit 4 and heated by the heating unit 5 is fed to the pressure-resistant container 6. The slurry fed to the pressure-resistant container 6 is introduced into the pressure-resistant nozzle 7 and then discharged therefrom.

The slurry introduced into the pressure-resistant nozzle 7 passes through the pressure resistant nozzle 7 where the slurry is pulverized to be reduced in diameter. Although there are three pressure-resistant nozzles 7 in the present embodiment, the number of the pressure-resistant nozzle 7 may be one or plural besides three. After completion of Step c1, i.e., the pulverizing stage that the amorphous resin particles flow through the pressure-resistant nozzle 7, the process proceeds to Step c2, i.e., the cooling and depressurizing stage.

At Step c2, i.e., at the cooling and depressurizing stage, the slurry obtained at the pulverizing stage is cooled and gradually depressurized to a level at which no bubbling is caused. In the present embodiment, the slurry is firstly cooled down by the cooling module 8 and then gradually depressurized by the depressurizing module 9 to a level at which no bubbling is caused. It is preferred that the depressurization be gradually carried out in a stepwise manner. No limitation is imposed on selection of the cooling temperature and the pressure. In the present embodiment, the slurry is cooled down by the cooling module 8 to a temperature equal to 40° C. or lower, and then depressurized by the depressurizing module 9 to the atmosphere pressure. As described above, the slurry is cooled down by the cooling module 8 immediately after the pulverizing stage, and subsequently depressurized by the depressurizing module 9 to a level at which no generation of bubbles (bubbling) is found, thereby preventing the bubbling form arising in the slurry and moreover preventing the coarsening which is caused by reaggregation of the resin-containing particles. The slurry which has been cooled by the cooling module 8 and depressurized by the depressurizing module 9 is discharged to outside of the depressurizing module 9 and brought through the piping 10 to the tank 2 where the slurry is to be contained again.

The finely-granulating step including the pulverizing stage and the cooling and depressurizing step as described above may be repeatedly carried out plural times according to need. The finely-granulating step is carried out until the volume average particle diameter of the resin-containing particles in the slurry falls in a range of from 0.4 μm to 1.0 μm. The volume average particle diameter of the resin-containing particles less than 0.4 μm indicates that the resin-containing particles are too small, which may cause the colorant and the release agent to be unevenly dispersed in the binder resin of the resin-containing particles. The volume average particle diameter of the resin-containing particles over 1.0 μm may cause difficulty in forming a small toner of which diameter falls in a range of from 4 μm to 8 μm.

The resin-containing particles are thus finely-granulated until the volume average particle diameter of the resin-containing particles falls in a range of from 0.4 μm to 1.0 μm, and the slurry containing the resin-containing particles of which volume average particle diameter falls in a range of from 0.4 μm to 1.0 μm is brought to the tank 2. The process then proceeds to the aggregating step.

(D) Aggregating Step

At the aggregating step, the resin-containing particles obtained at the finely-granulating step are aggregated. Operations at the aggregating step are carried out by using a commonly-used mixing apparatus such as a batch-type emulsifying machine and a dispersing machine. The emulsifying machine and the dispersing machine may be provided with a heating section, a stirring section and/or a rotating section which can give a shearing force to the toner raw material admixture, a mixing tank having a heat-retaining section, and the like component. Specific examples of the emulsifying machine and the dispersing machine include: a batch-type emulsifying machine such as Ultra Turrax (trade name) manufactured by IKA Japan K.K., Polytron Homogenizer (trade name) manufactured by Kinematica Co., and T.K. Autohomomixer (trade name) manufactured by Tokushu Kika Kogyo K.K.; a continuous-type emulsifying machine such as Ebara Milder (trade name) manufactured by Ebara Corporation, T.K. Pipeline Homomixer (trade name) manufactured by Tokushu Kika Kogyo K.K., T.K. Homomic Line Flow (trade name) manufactured by Tokushu Kika Kogyo K.K., Filmix (trade name) manufactured by Tokushu Kika Kogyo K.K., Colloid Mill (trade name) manufactured by Shinko Pantec Co., Ltd., Slusher (trade name) manufactured by Mitsui Miike Kakoki Co., Ltd., Trigonal Wet Grinder (trade name) manufactured by Mitsui Miike Kakoki Co., Ltd., Cavitron (trade name) manufactured by Eurotec, Ltd., and Fine Flow Mill (trade name) manufactured by Taiheiyo Kiko Co., Ltd.; Clearmix (trade name) manufactured by M Technique Co., Ltd.; and Filmics (trade name) manufactured by Tokushu Kika Kogyo K.K.

At an aggregate forming step, an aggregating agent is added to the toner raw material admixture, resulting in slurry which contains a toner aggregated material. The aggregating agent may be added without stirring but is preferably added under stirring. As the aggregating agent, it is possible to use heretofore known aggregating agents, among which a water-soluble polyvalent metal compound is preferable. Examples of the water-soluble polyvalent metal compound include: polyvalent metal halides such as calcium chloride, barium chloride, magnesium chloride, zinc chloride, and aluminum chloride; polyvalent metal salts such as calcium nitrate, aluminum sulfate, and magnesium sulfate; and inorganic metal salt copolymers such as polyaluminum chloride, polyaluminum hydroxide, and calcium polysulfide. Among these ingredients, polyvalent metal salts are preferable, and particularly preferable are divalent or trivalent metal sulfates such as magnesium sulfate and aluminum sulfate. A usage of the water-soluble polyvalent metal compound is not limited to a particular level and may be selected as appropriate from a wide range according to a final particle diameter of toner particle in view of types of the binder resin and the other toner components, a particle diameter of the resin-containing particle, and the like element. A usage of the water-soluble polyvalent metal compound may be preferably set to be around 0.1 part by weight to 10 parts by weight based on 100 parts by weight of the resin-containing particles. After the aggregating agent is added and the resin-containing particles are thereby aggregated, the process proceeds to the heating step.

(E) Heating Step

At the heating step, the slurry containing the toner-aggregated material obtained at the aggregated material forming step is heated to thereby form toner particles. A heating temperature is not limited to a particular level and preferably around the glass transition temperature of the binder resin constituting the resin particles. By appropriately adjusting the heating temperature and the heating time, it is possible to adjust a particle diameter of the toner particles being obtained. This can increase the mutual adhesion of the resin-containing particles and form an aggregate of the resin-containing particles into a substantial sphere.

Through the aggregating step and the heating step, the aggregate of the resin-containing particles will have a preferable size, for example, such a size that a volume average particle diameter of the resin-containing particles falls in a range of from 4 μm to 8 μm, and the process then proceeds to the cleaning step.

(F) Cleaning Step

At the cleaning step, the aggregate of the resin-containing particles is isolated from the slurry containing the aggregate of the resin-containing particles obtained through the aggregating step and the heating step, and subjected to cleaning by use of pure water, followed by drying. The toner of the invention is thus obtained. For isolating the aggregate of the resin-containing particles from the slurry, a commonly-used separating device is used such as a filtration device and a centrifuge. An electric conductivity of the pure water used for the cleaning is preferably 20 μS/cm or less. The pure water thus described can be obtained by a heretofore known method including an activated carbon method, an ion exchange method, a distillation method, and a reverse osmosis method. Further, a water temperature of the pure water is preferably around 10° C. to 80° C. The cleaning may be carried out until the electric conductivity of wash liquid (water used for the cleaning of the toner particles) reaches 50 μS/cm or less. After completion of the cleaning, the aggregate of the resin-containing particles is isolated from the wash liquid, and then dried whereby a toner of the invention is obtained.

By setting the volume average particle diameter of the aggregate of the resin-containing particles in the slurry to fall in a range of from 4 μm to 8 μm, for example, the toner of the invention has such a reduced diameter that a volume average particle diameter thereof is around 4 μm to 8 μm. The volume average particle diameter of the toner in a range of from 4 μm to 8 μm or enables stable formation of high-resolution images over a long period of time. The volume average particle diameter of the toner less than 4 μm may cause too high charging and too low fluidization. The toner which suffers from such too high charging and too low fluidization, will not be stably supplied to a photoreceptor, possibly causing problems such as generation of the background fog and a decrease of the image density. The toner of which volume average particle diameter exceeds 8 μm may not form high-resolution images. Furthermore, the larger particle diameter of the toner causes a specific surface area to be decreased, thus resulting in a smaller charge amount of the toner. The toner of which charge amount is small, cannot be stably supplied to a photoreceptor, possibly leading to contamination, that is, possibly causing the toner to be spattered inside the apparatus.

Further, the toner of the invention is reduced in diameter so that a volume average particle diameter thereof is around 4 μm to 8 μm, and moreover contains therein the release agent and the colorant which are further reduced in diameter and evenly dispersed in the toner. This is advantageous not only in image reproducibility, but also in that various problems due to bleeding out of the release agent are not caused.

Further, in forming the toner of the invention, the aggregate of the resin-containing particles is heated, which enhances mutual adhesion of the resin-containing particles. Inside the image forming apparatus, the aggregated resin-containing particles are thus prevented from being dissolved so that fine particles are not generated. Further, the heating of the aggregate of the resin-containing particles in forming the toner allows the toner to be formed into a substantial sphere, thereby enhancing toner charging stability. To be specific, it is possible to obtain a toner of which shape factor SF1 falls in a range of from 100 to 150. The shape factor SR1 herein represents a coefficient defined by the following formula (1).

$$SF1=[(\text{maximum length})^2/(\text{area})]\times(\pi/4)\times 100 \quad (1)$$

In the above formula (1), the maximum length represents an average value of maximum lengths of the toner particles seen in a projection image thereof, and the area represents an average value of projected areas of the toner particles seen in a projection image thereof. The maximum length and the area are obtained in a manner, for example, that an image observed through a scanning electron microscope (abbreviated as SEM) is viewed at a magnification of 500 times and analyzed by use of an image analysis software. The shape factor SF1 in a range of from 100 to 150 indicates that the toner is substantially spherical, which prevents the toner from chipping when the amorphous toner is stirred, with the result that fine particles due to such chipping are not generated.

Further, the toner of the invention contains as the toner raw material the release agent-dispersing aid for dispersing the release agent into the binder resin, which enhances the compatibility between the binder resin and the release agent, resulting in a state where the release agent is finely dispersed in the binder resin of the resin-containing particles. Accordingly, the toner formed of the aggregate of the resin-containing particles as described above has a smaller amount of the colorant and the release agent exposed on the surface of the toner as compared to the case of the toner which is composed of aggregated particles of respective components such as particles of the binder resin, particles of the colorant, and particles of the release agent. This contributes to prevention of blocking which is caused by thermal aggregation of the toner inside the image forming apparatus, thus enhancing the preservation stability of the toner.

Furthermore, the smaller amount of the release agent exposed on the surface of the toner can lead to a decrease in the detached amount of the release agent that is an amount of the release agent detached from the toner. This can prevent a content rate of the release agent to the toner from being decreased to a level lower than a content rate of the release agent to the toner raw material. Accordingly, it is possible to obtain a toner whose content rate of the release agent is favorable by giving a favorable amount of the release agent to the toner raw material. The favorable content rate of the release agent in the toner allows an increase of a temperature at which no high-temperature offset phenomenon arises, thus resulting in a toner which has a wide non-offset region.

Further, the toner formed of the aggregate of the resin-containing particles containing the binder resin, the colorant, the release agent, and the release agent-dispersing aid can be manufactured in a production method which is simpler than, for example, a method of manufacturing an encapsulated toner by coating with the fine resin particles the aggregate of particles of respective components such as particles of the binder resin, particles of the colorant, and particles of the release agent.

The toner of the invention may be subjected to surface modification by adding an external additive thereto. As the external additive, heretofore known ingredients can be used, including silica, titanium oxide, silicone resin, and silica and titanium oxide which are surface-treated with a silane coupling agent. Furthermore, a preferable usage of the external additive is 1 part by weight to 10 parts by weight based on 100 parts by weight of the toner.

The toner of the invention can be used in form of either one-component developer and two-component developer. In a case of being used in form of one-component developer, only toner is used without use of carriers while a blade and a fur brush are used to effect the fictional electrification at a developing sleeve so that the toner is attached onto the sleeve, thereby conveying the toner to perform image formation.

Further, the toner of the invention in a case of being used in form of two-component developer, is used together with a carrier. As the carrier, heretofore known ingredients can be used including, for example, single or complex ferrite composed of iron, copper, zinc, nickel, cobalt, manganese, and chromium, and carrier core particles of which surfaces are covered with a covering substance. As the covering substance, heretofore known ingredients can be used including polytetrafluoroethylene, a monochloro-trifluoroethylene copolymer, polyvinylidene-fluoride, silicone resin, polyester resin, a metal compound of di-tert-butylsalicylic acid, styrene resin, acrylic resin, polyacid, polyvinyl butyral, nigrosine, aminoacrylate resin, basic dyes or lakes thereof, fine silica powder, and fine alumina powder, which are preferably selected according to the toner components. Further, one of the above covering substances may be used each alone, or two or more of the above substances may be used in combination. A volume average particle diameter of the carrier is preferably 10 μm to 100 μm and more preferably 20 μm to 50 μm.

EXAMPLES

Hereinafter, the invention will be described more in detail with reference to Examples. In the following descriptions, "part" indicates "part by weight", and "%" indicates "% by weight", unless otherwise specified.

[Preparation of Water]

In the following Examples and Comparative examples, water having an electric conductivity of 0.5 μS/cm was used as water for preparing a water-based medium and as water for cleaning the toner particles. The cleaning water was prepared from tap water by using a super pure water preparation apparatus: Ultra Pure Water System CPW-102 (trade name) manufactured by ADVANTEC Co. The conductivity of water was measured by using a Lacom Tester: EC-PHCON 10 (trade name) manufactured by As One Corporation.

[Shape Factor SF1]

The shape factor SF1 of the toner was figured out in accordance with the following formula (1).

$$SF1=[(\text{maximum length})^2/(\text{area})]\times(\pi/4)\times 100 \quad (1)$$

The maximum length and the area were obtained in a manner that an image observed through a scanning electron microscope (abbreviated as SEM) is viewed at a magnification of 500 times and analyzed by use of an image analysis software: A-zo kun (trade name) manufactured by Asahi Kasei Engineering Corporation.

[Volume Average Particle Diameter and Variation Coefficient]

The volume average particle diameter of the toner particles was obtained by calculation on the basis of measurement of Coulter Multisizer II (trade name) manufactured by Coulter K.K. The number of particles for measurement was set at 50,000 counts, and an aperture diameter was set at 100 μm. The variation coefficient was figured out in accordance with the following formula (2) on the basis of the volume average particle diameter obtained from the measured particle diameters and a standard deviation of the volume average particle diameter.

$$\text{Variation coefficient}=\text{Standard deviation}/\text{Volume average particle diameter} \quad (2)$$

Further, the volume average particle diameter of the resin-containing particles was obtained in the same manner as above by using a laser diffraction/scattering particle size distribution analyzer LA-920 (trade name) manufactured by Horiba, Ltd.

[Softening Temperature of Binder Resin]

The softening temperature of the binder resin was measured as follows. Using a device for evaluating flow characteristics: Flow tester CFT-100C (trade name) manufactured by Shimadzu Corporation, 1 g of specimen was heated at a temperature of which increase rate was 6° C./min, under load of 10 kgf/cm$^2$ (980 k Pa) so that the specimen was pushed out of a die (nozzle). A temperature of the specimen at the time when a half of the specimen had flowed out of the die was determined as the softening temperature of the binder resin. Note that the die was 1 mm in opening diameter and 1 mm in length.

[Glass Transition Temperature (Tg) of Binder Resin]

The glass transition temperature (Tg) of the binder resin was measured as follows. Using a differential scanning calorimeter: DSC220 (trade name) manufactured by Seiko electronics Inc., 1 g of specimen was heated at a temperature of which increase rate was 10° C./min based on Japanese Industrial Standards (JIS) K7121-1987, thus obtaining a DSC curve. A straight line was drawn toward a low-temperature side extendedly from a base line on the high-temperature side of an endothermic peak corresponding to glass transition of the DSC curve which had been obtained as above. A tangent line was also drawn at a point where a gradient thereof was maximum against a curve extending from a rising part to a top of the peak. A temperature at an intersection of the straight line and the tangent line was determined as the glass transition temperature (Tg).

[Melting Point of Release Agent]

The melting point of the release agent was measured as follows. Using the differential scanning calorimeter: DSC220 (trade name) manufactured by Seiko electronics Inc., 1 g of specimen was heated from a temperature of 20° C. up to 150° C. at a temperature of which increase rate was 10° C./min, and then an operation of rapidly cooling down the specimen from 150° C. to 20° C. was repeated twice, thus obtaining a DSC curve. A temperature obtained at a top of an endothermic peak which corresponds to the melting shown on the DSC curve obtained at the second operation, was determined as the melting point of the release agent.

[Residual Rate of Release Agent]

As a residual rate of the release agent, a content rate of the release agent in the toner particles relative to a content rate of the release agent in the raw material was figured out. The content rate of the release agent in the toner particles was obtained as follows. Using the differential scanning calorimeter: DSC220 (trade name) manufactured by Seiko electronics Inc., a toner was evaluated as a measurement specimen. A heat amount absorbed by the release agent in the toner was obtained from an endothermic peak area belonging to the release agent. By comparing the obtained heat amount absorbed by the release agent with a raw material sample, the amount of the release agent contained in the toner particles was obtained.

Example 1

[Melt-Kneading Step]

As raw material monomers, prepared were 400 parts of polyoxypropylene (2.0)-2,2-bis(4-hydroxyphenyl)propane, 380 parts of polyoxyethylene (2.0)-2,2-bis(4-hydroxyphenyl)propane, and 330 parts of terephthalic acid. To polyester resin (having a glass transition temperature (Tg) of 62° C. and a softening temperature of 130° C.) which had been synthesized by using 3 parts of dibutyltin oxide as a catalyst, copper phthalocyanine (C.I. pigment blue 15:3) was added as a colorant. An admixture thus obtained was melt-kneaded for 40 minutes by a kneader of which temperature was set at 140° C., thereby manufacturing a master batch of which colorant concentration was 40%. The polyoxypropylene (2.0)-2,2-bis(4-hydroxyphenyl)propane mentioned herein represents a compound in which 2.0 mol on average of propylene oxide is added to 1.0 mol of 2,2-bis(4-hydroxyphenyl)propane. The polyoxyethylene (2.0)-2,2-bis(4-hydroxyphenyl)propane mentioned herein represents a compound in which 2.0 mol on average of ethyleneoxide is added to 1.0 mol of 2,2-bis(4-hydroxyphenyl)propane.

Next, a toner raw material was obtained by mixing and dispersing the following ingredients in the Henschel mixer for 3 minutes: 82.5 parts of polyester resin (having a glass transition temperature (Tg) of 62° C. and a softening temperature of 130° C.) which was the same as that used in fabricating the master batch; 12.5 parts of the master batch (having a colorant concentration of 40%) which had been fabricated as described above; as a release agent, 5 parts of paraffin wax (having a melting point of 75° C.) which was called HNP10 (trade name) manufactured by Nihon Seiro Co., Ltd.; as a release agent-dispersing aid, 3 parts of a copolymer composed of α-olefin-maleic anhydride copolymer and maleic anhydride monoester which was called Ceramer 1608 (trade name) manufactured by Toyo-Petrolite Co., Ltd.; and 2 parts of a charge control agent which was called TN105 (trade name) manufactured by Hodogaya Chemical Co., Ltd. The obtained toner raw material was melt-kneaded for dispersion by a twin screw extruder which was called PCM-30 (trade name) manufactured by Ikegai Co., thus preparing a resin kneaded material. Operation conditions of the twin screw extruder were set as follows: a cylinder set temperature was 110° C.; a barrel rotational speed was 300 rotations per minute (300 rpm); and a row material-feeding speed was 20 kg/h. The melt-kneaded material obtained as above was then cooled down to a room temperature, thereafter being coarsely pulverized by a cutter mill: VN-16 (trade name) manufactured by Orient Co., Ltd. to prepare the amorphous resin particles.

[Slurry Preparing Step]

Slurry containing the amorphous resin particles was prepared by mixing 94 parts of the amorphous resin particles obtained at the melt-kneading step and 20 parts of an aqueous solution containing 30% dispersion stabilizer: Joncryl 70 (trade name) manufactured by Johnson Polymer Corporation. The slurry prepared as above was made to pass through a nozzle having an inner diameter of 0.45 mm under pressure of 168 MPa, whereby the pretreatment was applied so that a particle diameter of the amorphous resin particles contained in the slurry was adjusted to be 100 μm or less.

[Finely-Granulating Step]

At finely-granulating step, the high-pressure homogenizer 1 shown in FIG. 2 was used for the pulverizing stage and the cooling and depressurizing stage.

At the pulverizing stage, the slurry containing the amorphous particles obtained at the slurry preparing step was pressurized at 210 MPa and heated to 110° C., and then supplied to a pressure-resistant nozzle through piping. The pressure-resistant nozzle is a 0.5 cm-long pressure-resistant multiple nozzle which is configured so that two liquid flowing holes each having a hole diameter of 0.143 mm are substantially parallel to each other in a longitudinal direction of the nozzle. At an inlet of the pressure-resistant nozzle, a temperature of the slurry was 110° C., and pressure imparted to the slurry was 210 MPa. At an outlet of the pressure-resistant nozzle, a temperature of the slurry was 120° C., and pressure imparted to the slurry was 42 MPa.

At the cooling and depressurizing stage, the slurry discharged from the pressure-resistant nozzle was led into a cooling module which is a corrugated tube-type cooling machine connected to the outlet of the pressure-resistant nozzle, where cooling was carried out. At an outlet of the cooling module, a temperature of the slurry was 30° C., and pressure imparted to the slurry was 35 MPa. The slurry discharged from the outlet of the cooling module was led into a depressurizing module which is a multistage depressurization apparatus, where depressurization was conducted. The depressurizing module mentioned here was composed of five pipe-shaped members of which inner diameters range of from 0.5 mm to 1 mm and which were coupled on each other in a stepwise manner from the member having a smaller inner diameter to the member having a larger inner diameter by using ring-shaped seals. The amorphous resin particles were thus finely granulated, resulting in slurry containing the resin-containing particles of which volume average particle diameter was 0.5 μm.

[Aggregating Step]

At the aggregating step and the later-described heating step, 500 parts of the slurry containing the resin-containing particles (which slurry contains 100 parts of the resin-containing particles as solid matters) obtained at the finely-granulating step, was stirred at 2,000 rpm while 5 parts, in total, of an aqueous solution containing 0.1% magnesium sulfate was added in form of drops to the slurry little by little, followed by one-hour stirring of the admixture. The resin-containing particles in the slurry were thus aggregated.

[Heating Step]

The slurry containing the aggregate of the resin-containing particles was heated to be 75° C., and then stirred at 2,000 rpm for 2 hours with the temperature of the slurry maintained at 75° C.

[Cleaning Step]

The aggregate of the resin-containing particles was isolated from the slurry by filtration, and then cleaned three times with pure water, thereafter being dried in a vacuum drier, thus resulting in the toner particles of the invention.

With 100 parts of the obtained toner particles were mixed 0.7 part of silica particles which had been hydrophobized with a silane coupling agent and of which average primary particle diameter was 20 nm, and 1 part of titanium oxide, thus resulting in the toner of Example 1.

Example 2

A toner of Example 2 was fabricated in the same manner as Example 1 except that an amount of the release agent was modified to 3 parts.

Example 3

A toner of Example 3 was fabricated in the same manner as Example 1 except that the release agent was replaced by polyethylene wax (having a melting point of 100° C.) which was called PW-665N (trade name) manufactured by Toyo-Petrolite Co., Ltd.

Example 4

A toner raw material was obtained by mixing and dispersing the following ingredients in the Henschel mixer for 3 minutes: 95 parts of polyester resin (having a glass transition temperature (Tg) of 62° C. and a softening temperature of 130° C.); as a release agent, 5 parts of paraffin wax (having a melting point of 75° C.) which was called HNP10 (trade name) manufactured by Nihon Seiro Co., Ltd.; as a release agent-dispersing aid, 3 parts of a copolymer composed of α-olefin-maleic anhydride copolymer and maleic anhydride monoester which was called Ceramer 1608 (trade name) manufactured by Toyo-Petrolite Co., Ltd.; and 2 parts of a charge control agent which was called TN105 (trade name) manufactured by Hodogaya Chemical Co., Ltd. The toner of Example 4 was obtained in the same manner as Example 1 except: that the obtained toner raw material was melt-kneaded for dispersion by a twin screw extruder which was called PCM-30 (trade name) manufactured by Ikegai Co., thus preparing a resin kneaded material; and that after fabrication of the slurry containing the resin-containing particles of which volume average particle diameter fell in a range of 0.4 μm to 1.0 μm, 10 parts of copper phthalocyanine (C.I. pigment blue 15:3 serving as a colorant) was mixed with the slurry by a mixer called a Henschel mixer (trade name) manufactured by Mitsui Mining Co., thus preparing a toner raw material admixture which contains resin-containing particles containing no colorant, and colorant particles, followed by aggregation.

Example 5

A toner of Example 5 was fabricated in the same manner as Example 1 except that the stirring time at the heating step was modified to 30 minutes.

Comparative Example 1

A toner of Comparative example 1 was fabricated in the same manner as Example 1 except that no release agent-dispersing aid was used.

Comparative Example 2

A toner of Comparative example 2 was fabricated in the same manner as Example 1 except that at the finely-granulating step, the slurry was obtained that contained the resin-containing particles of which volume average particle diameter was 1.2 μm.

Table 1 shows property values of the toners of Examples and Comparative examples which were obtained as described above. The content of the release agent in Table 1 represents a ratio of the release agent to 100 parts of the binder resin. Further, $D_{50}$ in Table 1 represents a volume average particles diameter.

TABLE 1

| | Release agent | | | Resin-containing particles | toner | | |
|---|---|---|---|---|---|---|---|
| | Melting Point (° C.) | Content rate (part by weight) | Residual rate (%) | $D_{50}$ (μm) | $D_{50}$ (μm) | variation coefficient | Shape factor SF1 |
| Ex. 1 | 75 | 6.1 | 100 | 0.5 | 6.0 | 28 | 131 |
| Ex. 2 | 75 | 3.6 | 100 | 0.6 | 6.2 | 28 | 138 |
| Ex. 3 | 100 | 6.1 | 100 | 0.5 | 6.3 | 29 | 140 |
| Ex. 4 | 75 | 6.1 | 100 | 0.5 | 5.9 | 27 | 135 |
| Ex. 5 | 75 | 6.1 | 100 | 0.6 | 6.0 | 31 | 152 |
| Com. ex. 1 | 75 | 6.1 | 64 | 0.6 | 6.1 | 28 | 137 |
| Com. ex. 2 | 75 | 6.1 | 100 | 1.2 | 9.3 | 35 | 154 |

[Property Evaluation]

The toners obtained in Examples 1-5 and Comparative examples 1 and 2 were respectively mixed with ferrite core carriers which serve as carriers and of which volume average particle diameter was 60 μm so that a concentration of the toner was 4%, thus preparing a two-component developer. Using the obtained two-component developer, an image for evaluation was formed as follows, and the evaluations listed below were conducted.

[Formation of Image for Evaluation]

The obtained two-component developer was put in a developing device of a test printer which was obtained by removing a fixing device from a commercially-available printer: LIBRE AR-S505 (trade name) manufactured by Sharp Corporation. By using the test printer, a 20 mm×50 mm rectangular solid image part was formed, though not fixed, on a recording sheet with a toner of which amount attached thereto was adjusted to 0.4 mg/cm$^2$. The recording sheet was A4-sized as defined in accordance with Japanese Industrial Standards (JIS) P0138. Subsequently, an external fixing machine having a heating roller for fixing was used to fix a thus-formed unfixed toner image onto the recording sheet which was fed at a speed of 120 mm/sec, thereby forming an image for evaluation. As the external fixing machine, an oil-less fixing device was taken out of a commercially-available full-color copier: LIBRE AR-C260 (trade name) manufactured by Sharp Corporation, and adapted to have a heating roller of which surface temperature can be set at a given degree. The oil-less fixing device herein means a fixing device which performs the fixing operation with a heating roller not coated by a release agent such as silicone oil.

[Evaluation of Non-Offset Region]

An image for evaluation thus formed was observed and checked with eyes whether or not a toner image was transferred from the heating roller onto a white background part of the recording sheet which part should be a blank, thereby determining whether or not the high-temperature offset phenomenon appeared. This operation was repeated with the surface temperature of the heating roller sequentially rising by 5° C. from 100° C. to 210° C. By so doing, the non-offset region was found where neither of the phenomena arose: the low-temperature offset phenomenon that no toner image was fixed on the recording sheet; and the high-temperature offset phenomenon that a toner image was transferred from the heating roller onto the white background part of the recording sheet which part should be a blank. The anti-offset property was thus evaluated. The non-offset region is determined from a difference in temperature between a minimum fixing temperature that is the lowest temperature of the heating roller at which the low-temperature offset phenomenon does not appear and a maximum fixing temperature that is the highest temperature of the heating roller at which the high-temperature offset phenomenon does not appear. The evaluation of the non-offset region was shown based on the following standards: "Good" was given for the case where the non-offset region ranges over a temperature equal to 40° C. and more; and "Poor" was given for the case where the non-offset region ranges below a temperature less than 40° C.

[Image Density]

A reflection densitometer: RD918 (trade name) manufactured by Macbeth Co. was used to measure optical reflection density of a solid image part in an image formed by the heating roller of which surface temperature was 170° C. Density thus obtained was defined as image density. In the case where the image density was 1.40 or more, the evaluation "Good" was given, and in the case where the image density was less than 1.40, the evaluation "Poor" was given.

[Chroma Saturation]

For the image formed by the heating roller of which surface temperature was 170° C., a spectrophotometer: X-Rite 938 (trade name) manufactured by X-Rite Co. was used to obtain a chromatic coordinate, i.e., a* and b* in L*a*b* color system (CIE1976) defined by Japanese Industrial Standards (JIS) Z8729. And a value of ab chroma, i.e., C*ab was obtained by calculation based on the following formula (3).

$$C^*ab=[(a^*)2+(b^*)^2]^{1/2} \quad (3)$$

Using the obtained value of ab chroma (C*ab) as an evaluation index, the chroma saturation was evaluated based on the following evaluation standards.

Good: A favorable result was obtained with ab chroma (C*ab) of 60 or more.

Not bad: No problem was caused in practical use with ab chroma (C*ab) of 55 or more and less than 60.

Poor: An unsatisfactory result was obtained with ab chroma (C*ab) less than 55.

[Comprehensive Evaluation]

A comprehensive evaluation was conducted including the above-mentioned evaluation of non-offset region, evaluation of image density, and evaluation of chroma saturation. In the comprehensive evaluation, the evaluation "Good" was given for the case where no "Poor" were given in all the evaluation items while the evaluation "Poor" was given for the case where one or more "Poor" was/were given in the evaluation items.

Table 2 shows the evaluation results mentioned above.

TABLE 2

| | Fixing temp. (° C.) | | Non-offset property | | Image Density | | Chroma Saturation | | Comprehensive |
|---|---|---|---|---|---|---|---|---|---|
| | Min. Temp. | Max. Temp. | Non-offset Region (° C.) | Evaluation | Measurement | Evaluation | Measurement | Evaluation | Evaluation |
| Ex. 1 | 140 | 190 | 50 | Good | 1.45 | Good | 62 | Good | Good |
| Ex. 2 | 150 | 190 | 40 | Good | 1.42 | Good | 61 | Good | Good |
| Ex. 3 | 170 | 210 | 40 | Good | 1.41 | Good | 60 | Good | Good |
| Ex. 4 | 140 | 190 | 50 | Good | 1.43 | Good | 58 | Not bad | Good |
| Ex. 5 | 140 | 190 | 50 | Good | 1.38 | Not bad | 58 | Not bad | Good |
| Com. Ex. 1 | 160 | 180 | 20 | Poor | 1.41 | Good | 58 | Not bad | Poor |
| Com. Ex. 1 | 140 | 190 | 50 | Good | 1.30 | Poor | 56 | Not bad | Poor |

The toners of Examples 1-5 each contained a release agent-dispersing aid as a toner raw material and were each composed of aggregate of resin-containing particles of which volume average particle diameter was 0.4 μm to 1.0 μm. Table 2 shows that the toners of Examples 1-5 each had a high residual rate of the release agent and were able to secure a wide non-offset region of 40° C. or more. Further, the toners of Examples 1-5 each had the release agent not exposed on surfaces of toner particles and therefore were excellent in preservation stability with uniformly-charging performance. Images formed by the toners of Examples 1-5 were thus excellent in a transferring property with high image density and high chroma saturation.

Further, the toners of Examples 1-4 were each kept heated under stirring for 2 hours at the heating step and therefore, as shown in Table 1, resulted in such a small variation coefficient as 29 or less and exhibited a narrow particle size distribution with uniform particle diameters and a favorable shape factor SF1 falling in a range of from 100 to 150. Accordingly, the toners of Examples 1-4 each exhibit more uniformly-charging performance and were able to form an image of which image density was so high that optical reflection density of the image was 1.40 or more. Furthermore, Tables show that the toners of Examples 1, 2, 4, and 5 which contain the release agent having a melting point of 80° C. or less, each had a minimum fixing temperature of 150° C. or less, thus being excellent in the low-temperature fixing property.

The toner of Comparative example 1 contained no release agent-dispersing aid as a toner raw material and was composed of aggregate of resin-containing particles of which volume average particle diameter was 0.4 μm to 1.0 μm. The toner of Comparative example 1 had a lower residual rate of the release agent and was inferior in terms of an area of the non-offset region as compared to those of the toners of Examples 1-5.

Further, the toner of Comparative example 2 contained a release agent-dispersing aid as a toner raw material and was composed of aggregate of resin-containing particles of which volume average particle diameter exceeded 1.0 μm. As shown in Table 1, the toner of Comparative example 2 had such a large volume average particle diameter as 9.3 μm and such a large variation coefficient as 35 with a wide particle size distribution, nonuniform particle diameters, and a shape factor SF1 of 154, thus being amorphous. The toner of Comparative example 2 as described above was poor in a uniformly-charging performance and inferior in terms of image density as compared to the toners of Examples 1-5.

As described above, the toner of the invention which contained the release agent-dispersing aid as a toner raw material and were composed of aggregate of resin-containing particles diameters having a volume average particle diameter in a range of from 0.4 μm to 1.0 μm, was able to be manufactured in a simple production method and moreover was excellent in preservation stability and anti-offset property.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner formed of aggregate of resin-containing particles which are obtained by finely granulating a slurry of amorphous resin particles containing a binder resin, a colorant, a release agent, and a release agent-dispersing aid using a high-pressure homogenizer method, the resin-containing particles having a volume average particle diameter in a range of from 0.4 μm to 1.0 μm, wherein the binder resin consists of a polyester resin, and the release agent-dispersing aid is selected from a styrene-ethylene-butadiene block copolymer, a styrene-methyl methacrylate block copolymer, an ethylene-styrene graft copolymer, maleic anhydride copolymer, and a copolymer of an α-olefin-maleic anhydride copolymer and maleic anhydride monoester.

2. The toner of claim 1, wherein the high-pressure homogenizer method comprises:

a pulverizing step of forming a heated and pressurized slurry containing resin-containing particles by passing a slurry of amorphous resin particles through a pressure-resistant nozzle under heat and pressure to pulverize the amorphous resin particles; and a cooling and depressurizing step of cooling down the slurry obtained at the pulverizing step and gradually depressurizing the slurry to a pressure level at which no bubbling is caused.

3. The toner of claim 1, wherein an aggregate of the resin-containing particles is heated.

4. The toner of claim 1, wherein a content of the release agent is 5 parts by weight or more based on 100 parts by weight of the binder resin.

5. The toner of claim 1, wherein a melting point of the release agent is 80° C. or less.

6. The toner of claim 1, wherein a shape factor SF1 falls in a range of from 100 to 150.

7. A method of manufacturing a toner, comprising:

a finely-granulating step of forming resin-containing particles having a volume average particle diameter in a range of from 0.4 μm to 1.0 μm by finely granulating amorphous resin particles containing a binder resin, a colorant, a release agent, and a release agent-dispersing aid; and an aggregating step of aggregating the resin-containing particles obtained at the finely-granulating step.

8. The method of claim 7, further comprising a heating step of heating an aggregate of the resin-containing particles obtained at the aggregating step, the resin-containing particles having a volume average particle diameter in a range of from 0.4 μm to 1.0 μm or less.

* * * * *